US006519968B1

(12) United States Patent
Konarski

(10) Patent No.: US 6,519,968 B1
(45) Date of Patent: Feb. 18, 2003

(54) SHIPPING CONTAINER FOR EXOTHERMIC MATERIAL

(75) Inventor: Mark M. Konarski, Old Saybrook, CT (US)

(73) Assignee: Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/852,158

(22) Filed: May 9, 2001

(51) Int. Cl.[7] ..... F25D 3/08
(52) U.S. Cl. ..... 62/371; 62/372; 62/457.2
(58) Field of Search ..... 62/371, 457.2, 62/372

(56) References Cited

U.S. PATENT DOCUMENTS

| | | | | |
|---|---|---|---|---|
| 4,292,817 A | * | 10/1981 | Loucks | 62/457 |
| 4,294,079 A | * | 10/1981 | Benson | 62/60 |
| 4,377,075 A | | 3/1983 | Russo | |
| 4,509,587 A | * | 4/1985 | Clark et al. | 165/61 |
| 4,530,816 A | | 7/1985 | Douglas-Hamilton | |
| 4,573,581 A | | 3/1986 | Galloway et al. | |
| 4,903,493 A | | 2/1990 | Van Iperen et al. | |
| 4,947,658 A | * | 8/1990 | Wheeler et al. | 62/372 |
| 5,042,260 A | * | 8/1991 | George, Sr. | 62/60 |
| 5,355,684 A | | 10/1994 | Guice | |
| 5,355,869 A | * | 10/1994 | Pickard et al. | 126/263 |
| 5,899,088 A | * | 5/1999 | Purdum | 62/371 |
| 5,924,302 A | * | 7/1999 | Derifield | 62/457.2 |
| 6,044,650 A | * | 4/2000 | Cook et al. | 62/130 |
| 6,070,427 A | | 6/2000 | Fine et al. | |
| 6,189,330 B1 | * | 2/2001 | Retallick et al. | 62/371 |
| 6,233,965 B1 | * | 5/2001 | Choy | 62/371 |
| 6,257,764 B1 | * | 7/2001 | Lantz | 383/105 |

FOREIGN PATENT DOCUMENTS

| | | |
|---|---|---|
| EP | 0 908 399 A1 | 4/1999 |
| EP | 0 718 212 B1 | 10/1999 |

* cited by examiner

*Primary Examiner*—William C. Doerrler
*Assistant Examiner*—Mark Shulman
(74) *Attorney, Agent, or Firm*—Hoffmann & Baron, LLP

(57) ABSTRACT

A shipping container for exothermic material comprises an outer container and a plurality of inner containers enclosed within the outer container with a quantity of coolant material adjacent the inner containers. Each inner container includes a box defining an enclosure, a fluted insert disposed within such enclosure for supporting a plurality of vessels, such as plastic syringes containing exothermic material. Each fluted insert includes a plurality of open ended recesses for receiving the syringes separated by upstanding walls defining a barrier between the supported syringes. A pair of heat shields, one at the bottom and one at the top of each inner box, is included for dissipating heat therewithin. Plural inner containers housing exothermic material are bubble-wrapped in a stacked arrangement with gel packs between each inner container. The wrapped stack of inner containers are then placed in an outer container which is then filled with a quantity of dry ice and covered to close the shipping container for transportation.

12 Claims, 1 Drawing Sheet

SHIPPING CONTAINER FOR EXOTHERMIC MATERIAL

FIELD OF THE INVENTION

The present invention relates to a shipping container and, more particularly, to a shipping container for transporting exothermic material.

BACKGROUND OF THE INVENTION

It is often required to transport packages of exothermic materials from a supplier to a customer for its intended application. An exothermic material, as used herein, is a type of material which can react and give off significant amounts of heat when it reaches temperatures at or above certain ambient temperatures. One type of exothermic material are formulations of highly reactive epoxies which typically include a resin and a hardener, which are combined at the point of manufacture and are sold in syringes or other vessels as a single homogeneous material. When such materials reach their reaction temperature, they react rapidly and release a significant amount of heat. Prior to shipment to customers, and in order to prevent premature reaction and curing, these materials are maintained at very low temperatures in order to slow or completely suppress the reaction process.

Shipping of the exothermic materials from the manufacturer to the customer presents difficulties when suitable temperature controlled transport means, such as refrigerated vehicles, cannot be used. One example of a shipping and packaging system uses heat sinks and other coolant and temperature control means for keeping materials cool during shipment. See U.S. Pat. No. 6,070,427, issued on Jun. 6, 2000 to Fine et al., which discloses a shipping and storage system for transporting exothermic materials. Fine et al. discloses a heat sink material disposed inside the container that is adapted to hold and be in intimate contact with one or more packages of exothermic materials. The heat sink material has an effective heat capacity and latent heat of melting and/or vaporization such that it will absorb all of the energy given off by the exothermic material if the material reacts by reaching its reaction initiation temperature.

Fine et al. also discloses the use of optional cooling means disposed in the container surrounding the heat sink and packaged exothermic material. While certain of the known shipping and packaging systems have their advantages, it is still desirable to provide a shipping container that can be used for the safe transportation of exothermic materials in a cost-effective and efficient manner.

SUMMARY OF THE INVENTION

In accordance with one form of the invention, a shipping container for exothermic material comprises an outer container, at least one inner container within the outer container, and a coolant within the outer container and adjacent the at least one inner container. The inner container comprises a box defining an enclosure and a support disposed within the enclosure for supporting a plurality of vessels containing exothermic material. The support defines a barrier between the vessels containing the exothermic material. A heat shield is disposed within the enclosure having an extent traversing the plurality of vessels.

BRIEF DESCRIPTION OF THE DRAWING

The sole drawing FIGURE is a partial cross-sectional view of a shipping container for exothermic material in accordance with a particular arrangement of the present invention.

DETAILED DESCRIPTION OF THE PREFERRED EMBODIMENTS

Figure 1:
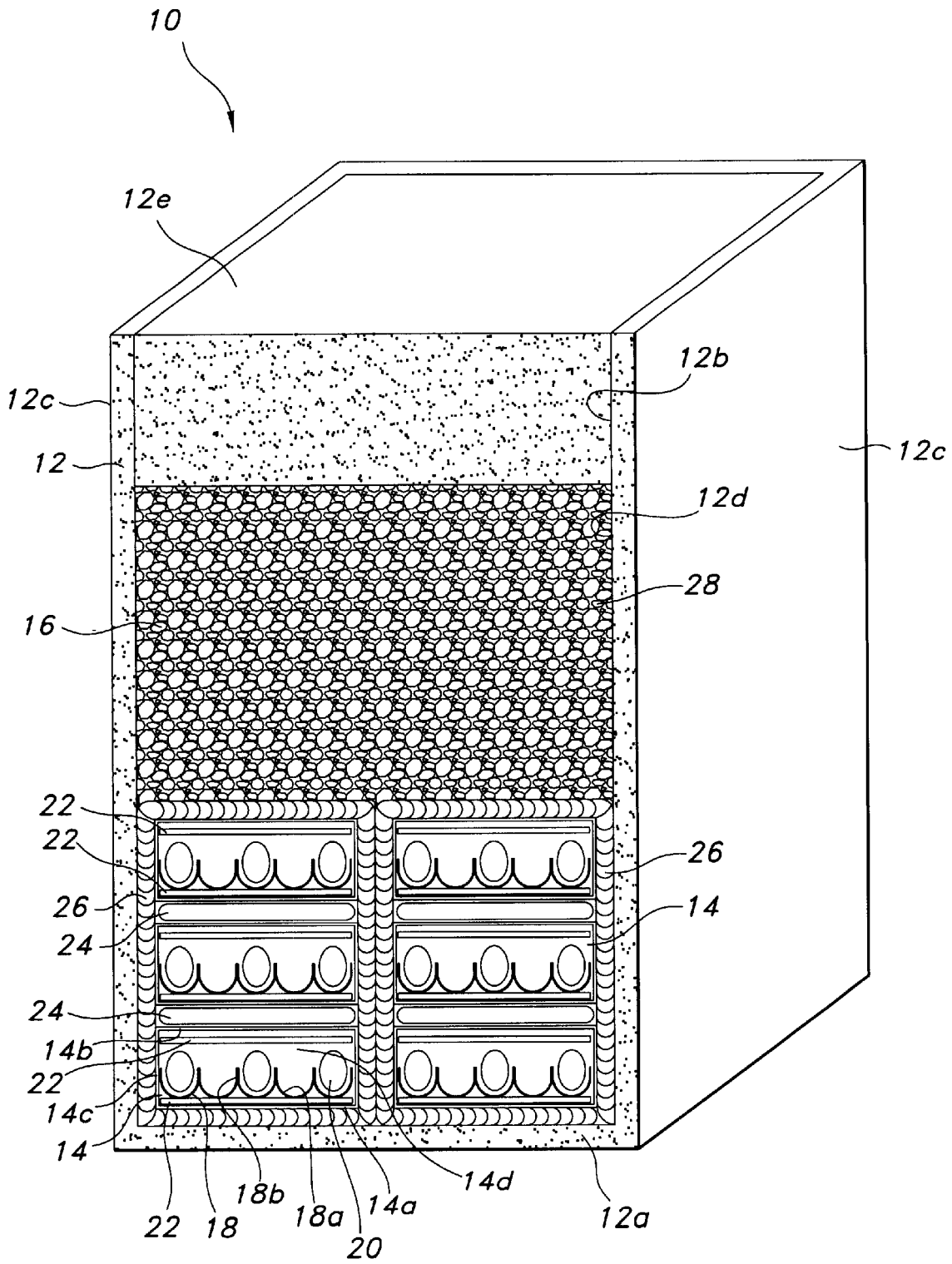

Referring now to the drawing FIGURE, there is shown in accordance with a particular arrangement of the invention, a shipping container 10 for use in transporting exothermic materials. The shipping container generally comprises an outer container 12 enclosing a plurality of inner containers 14, each of which contains exothermic materials, and a suitable coolant 16.

In the particular arrangement shown, outer container 12 is a box of generally rectangular configuration having a bottom wall 12A, a top opening 12B and four spaced side walls 12C, defining an enclosure 12D therewithin. The box of outer container 12 is preferably formed of thermally insulative material, such as rigid polyurethane, although other suitable thermally insulative materials may be used. The outer container 12 further includes a cover 12E, also preferably formed of rigid polyurethane, that is configured to reside within enclosure 12D over coolant 16 to close the shipping container 10 prior to shipping, as will be described.

In the particular arrangement being described, each of the inner containers 14 is preferably of the same size and configuration for ease of packaging and cost, although it should be appreciated that other configurations of the inner container 14 may be used. As shown, each inner container 14 comprises a box, made of suitable packaging material such as corrugated cardboard. Each box is generally rectangular in configuration, comprising a bottom wall 14A, a top wall 14B and four spaced side walls 14C, defining therewithin an inner enclosure 14D. The top wall 14B of each inner enclosure is preferably hingedly openable for access to inner enclosure 14D.

Supported within the enclosure 14D of each inner container 14 is a fluted insert 18 for individually supporting vessels 20 that contain exothermic material. Fluted insert 18 is made of a suitable packaging material, such as corrugated cardboard, although other materials may be used. Fluted insert 18 is defined by a plurality of adjacent open ended recesses 18A separated by a plurality of upstanding walls 18B, thereby establishing a structural barrier between each of the recesses 18A.

Disposed in the inner enclosure 14D of each inner container 14 are a pair of heat shields 22, one of which is placed between the fluted insert 18 and the bottom wall 14A of inner container 14 and the other heat shield 22 being disposed between the fluted insert 18 and the top wall 14B of the inner container 14. Each heat shield 22 is preferably formed of thermally conductive material. Each heat shield 22 is substantially planar and is of rectangular shape to be compatible with the configuration of the inner box 14. Each heat shield 22 is formed to fit within the side walls 14C without much clearance and to be of extent to completely traverse and cover the vessels so residing in the flute insert 18. In a preferred construction, each heat shield 22 may be formed of a sheet of stainless steel, on the order of about 0.010 inch thick.

Having described the individual elements of the shipping container 10, the assembly thereof is now described. Within each inner box 14, a heat shield 22 is placed on the bottom wall 14A with a fluted insert 18 placed thereon. Vessels 20, preferably in the form of conventional plastic syringes, are filled with self-reactive exothermic materials, such as a one-part epoxy-amine mixture. Such material includes Loctite microelectronic epoxy produced by the assignee of the subject invention. Three syringes 20, for example, are placed in the open recesses 18A of the fluted insert 18. The syringes

20, in the particular arrangement, occupy only three of the five recesses 18A such that there exists between each syringe 20 a barrier defined by the fluted insert upstanding walls 18B as well as an unoccupied recess 18A. A second heat shield 22 is placed within the inner box 14 over the three syringes 20. Each of the heat shields 22 within each inner container 14 serves as a heat sink through which heat may be spread and further dissipated. The top wall 14B of each inner container 14 is then closed and suitably sealed.

The inner containers 14 so assembled are then stacked as illustrated in the drawing FIGURE. In the particular arrangement shown, there are two stacks of three inner containers 14, although other stacking arrangements may be contemplated. Disposed between each of the inner containers 14 is a suitable coolant, such as a commercially available gel pack 24. Each stack of three inner boxes with gel packs 24 therebetween is then wrapped with a suitable insulative layer 26, such as a conventionally available bubble wrap material. It should be appreciated that, while each stack comprises three inner containers 14 suitably wrapped in bubble wrap 26, all six inner containers 14 may be so wrapped or other variations thereof.

The stacked inner containers 14 are then placed within the enclosure 12D of the outer container 12 on the bottom wall 12A thereof. A suitable quantity of coolant, such as conventionally available dry ice 28 is placed on top of the bubble wrapped inner containers 14. The outer container cover 12E is then placed within enclosure 12D on top of the dry ice 28 and is suitably sealed to form the finally assembled shipping container 10.

The amount of coolant to be used, for example, will depend upon the temperature range that is required or desired and the time period during which the temperature range must be kept. Indeed, simple tests can be run to determine the inside temperatures of the containers over the required period of time to determine if the exothermic material intended for transportation can be safely packaged for shipment. For example, in the shipping container 10 of the subject invention, six 30-cc syringes of a Loctite microelectronic material were loaded into the fluted insert 18 in the inner box 14. In this particular configuration, each inner box 14 contains two side-by-side fluted inserts, each insert having five syringe recesses 18A for a total of ten spaces within each box. Only six syringes 20 were loaded into the inserts, three syringes per insert so that each syringe 20 was thermally insulated from each other. Six inner containers 14, each containing 6 syringes of Loctite microelectronic epoxy, were then bubble-wrapped and placed in the outer container 12 with a minimum of about 60 pounds of dry ice 28. The shipping container 10 was then placed in an oven at 55° C. After several hours, a sharp exotherm occurred as the material gelled within the syringes 20. Peak temperatures were noted at about 181° C. for the syringes and 86° C. for the inner box surface. It was concluded that, although the temperature of the syringes 20 exceeded the melting/softening point of the plastic syringe body, the epoxy product was well contained since it rapidly solidified as the peak temperature was reached. No damage to the boxes was observed thereby resulting in the conclusion that the shipping container 10 could be used to safely transport the subject exothermic materials.

Having described the preferred form of the present invention herein, it should be understood that variations may be made thereto without departing from the contemplated scope thereof. Accordingly, the preferred arrangements described herein are intended to be illustrative rather than limiting, the true scope of the invention being set forth in the claims.

What is claimed is:

1. A shipping container for exothermic material, comprising an outer container;

at least one inner container within said outer container; and a coolant within said outer container and adjacent said at least one inner container;

said at least one inner container comprising:

(a) a box defining an enclosure;

(b) a support disposed within said enclosure for supporting a plurality of vessels containing exothermic material, said support defining a barrier between said vessels; and (c) a heat shield within said enclosure having an extent traversing said plurality of vessels, said heat shield being formed of conductive material for dissipation of heat therewithin.

2. A shipping container according to claim 1, wherein said support comprises a fluted insert defining a plurality of open-ended recesses for supporting said vessels, said fluted insert further including a plurality of upstanding walls on either side of said recesses defining said barriers.

3. A shipping container according to claim 2, wherein said fluted insert is formed of corrugated cardboard.

4. A shipping container according to claim 2, wherein said heat shield is substantially planar and is disposed within said enclosure between said fluted insert and bottom wall of said inner container.

5. A shipping container according to claim 2, wherein said heat shield is substantially planar and is disposed within said enclosure between the openings of said recesses and a top wall of said inner container.

6. A shipping container according to claim 5, further including a substantially planar heat shield disposed between said enclosure between said fluted insert and a bottom wall of said inner container.

7. A shipping container according to claim 2, wherein said inner box is formed of corrugated cardboard having spaced opposed side walls and spaced opposed bottom and top walls, one of said side, bottom or top walls being openable for access to said enclosure.

8. A shipping container according to claim 1, further comprising a plurality of inner containers disposed in said outer container in a stacked arrangement.

9. A shipping container according to claim 8, wherein said coolant includes cooling members disposed between said inner containers.

10. A shipping container according to claim 9, wherein said stacked inner containers and said cooling members are wrapped in an insulative layer.

11. A shipping container according to claim 10, wherein said coolant comprises a quantity of cooling material disposed over said insulative layer.

12. A shipping container according to claim 11, wherein said outer container comprises a cover disposed over said cooling material and closing said outer container.

* * * * *